US006357486B2

(12) United States Patent
Braun

(10) Patent No.: US 6,357,486 B2
(45) Date of Patent: Mar. 19, 2002

(54) METHOD AND DEVICE FOR DETECTING JACQUARD SHED ANOMALIES

(75) Inventor: Dominique Braun, Faverges (FR)

(73) Assignee: Staubli Faverges, Faverges (FR)

( * ) Notice: Subject to any disclaimer, the term of this patent is extended or adjusted under 35 U.S.C. 154(b) by 0 days.

(21) Appl. No.: 09/853,624

(22) Filed: May 14, 2001

(30) Foreign Application Priority Data

May 15, 2000 (FR) ..... 00 06164

(51) Int. Cl.[7] ..... D03C 3/20; D03C 13/00
(52) U.S. Cl. ..... 139/59; 139/455
(58) Field of Search ..... 139/455, 59

(56) References Cited

U.S. PATENT DOCUMENTS

| | | | | |
|---|---|---|---|---|
| 5,070,913 A | * | 12/1991 | Palmer | 139/455 |
| 5,613,526 A | * | 3/1997 | Palau et al. | 139/455 |
| 6,070,619 A | * | 6/2000 | Tamura et al. | 139/110 |
| 6,092,564 A | | 7/2000 | Bourgeaux et al. | |
| 6,105,630 A | * | 8/2000 | Braun et al. | 139/455 |

FOREIGN PATENT DOCUMENTS

| | | |
|---|---|---|
| EP | 0307025 | 3/1989 |
| FR | 2772796 | 6/1999 |

OTHER PUBLICATIONS

Hattori Masanobu, Patents Abstracts of Japan, vol. 1999, No. 5, May 31 1999, & JP 11 050344 A (Toyota Autom Loom Works LTS), Feb. 23, 1999.

* cited by examiner

*Primary Examiner*—Andy Falik
(74) *Attorney, Agent, or Firm*—Dowell & Dowell, P.C.

(57) ABSTRACT

In a weaving loom of the Jacquard type comprising electrical actuators for displacing heddles controlling the position of the warp yarns, the following steps are carried out:

a so-called "normal effort" is determined, exerted by at least one actuator on at least one harness cord in order to displace, between two positions of its normal stroke, at least one heddle connected to a normally taut warp yam;

from this normal effort, at least one threshold value representative of a limit of a range of values of normal weaving effort is determined;

while the loom is in operation, a so-called "operational effort" exerted by this actuator on the harness cord is determined;

at least one value representative of this operational effort is compared with the threshold value, and a first, so-called "anomaly signal" is generated when the value representative of the operational effort is outside the afore-mentioned range.

The device comprises a logic unit incorporating a comparator and associated with a memory and a display means.

13 Claims, 4 Drawing Sheets

METHOD AND DEVICE FOR DETECTING JACQUARD SHED ANOMALIES

BACKGROUND OF THE INVENTION

1. Field of the Invention

The present invention relates to a method and to a device for detecting an anomaly in the formation of the shed in a Jacquard-type weaving loom. The invention also concerns a weaving loom equipped with such a device.

2. Brief Description of the Related Art

FR-A-2 772 796 for example discloses using an electrical actuator for controlling the displacement of the harness cords of a Jacquard loom harness.

Furthermore, it is known to equip a Jacquard-type weaving loom with a so-called "warp stop motion" device which comprises metallic drop wires supported by each of the warp yarns of the loom and conducting bars extending over the width of the loom. In the event of rupture of a warp yam, the drop wire that it supports comes, under the effect of its own weight, into contact with conducting bars, which creates an electrical contact between these conducting bars which are made alive. Such contact can be detected by an electrical monitoring system, which makes it possible to interrupt the operation of the loom immediately and to draw an operator's attention, for example with the aid of a telltale lamp. However, such a warp stop motion device presents considerable limitations. Firstly, once the loom is stopped, the operator must seek which warp yam is effectively broken, which involves manually displacing the drop wires in order to identify the one which is creating the contact. This operation may be long and requires qualified manpower. In addition, the positioning of the metallic drop wires on the different warp yams, sometimes called "threading", is a long and expensive operation. The cost of the equipment used for effecting the warp stop motion is non negligible, since it must include one drop wire for each warp yarn, i.e. for example up to more than 10,000 drop wires, and conducting bars having to be incorporated in the structure of the loom and supplied with voltage. Moreover, the known warp stop motion devices are sensitive to pollution due to the flock which is most often produced during the weaving operations. It is therefore necessary to provide periodic cleaning operations for this device.

It is a more particular object of the present invention to overcome these drawbacks by proposing a novel method for detecting an anomaly which does not require resorting to a conventional warp stop motion device and allows reliable and rapid detection and identification of a broken warp yarn, a damaged elastic return element, or a broken harness cord or one disconnected from the corresponding heddle.

SUMMARY OF THE INVENTION

To that end, the invention relates to a method for detecting an anomaly in the formation of the shed in a Jacquard-type weaving loom comprising electrical actuators for displacing the heddles controlling the position of the warp yarns of the loom. This method consists in:

determining a so-called "normal effort" or "normal weaving effort", exerted by at least one actuator on at least one harness cord in order to displace, between two positions of its normal stroke, at least one heddle connected to a normally taut warp yarn;

determining, from this normal effort, at least one threshold value representative of a limit of a range of values of normal weaving effort;

determining, while the loom is in operation, a so-called "operational effort" exerted by this actuator on this harness cord;

comparing at least one value representative of this operational effort with the threshold value, and generating a first, so-called "anomaly signal" when the value representative of the operational effort is outside the range defined by the threshold value.

The method of the invention takes advantage of the fact that it is possible to determine the efforts exerted by an electrical actuator without resorting to ancillary mechanical devices, while the operations of memorization, comparison and logic processing may be carried out in an electronic controller used, furthermore, for controlling the actuators. The method of the invention dispenses with the operation of threading of the warp stop motion drop wires, this allowing an appreciable saving of time and consequently reducing the operating costs of the loom. In addition, the method allows a rapid and precise identification of the position of a warp yarn at the level of which the shed does not conform to the desired weave, whether it be due to a rupture of this yarn, to a dysfunction of the elastic return means or to a defect in the kinematic link between the actuator and the heddle, as the actuator for which an anomaly signal is generated is immediately located.

According to advantageous but non-compulsory aspects of the invention, the method incorporates one or more of the following characteristics:

It further consists in determining a so-called "no load effort", exerted by the actuator on at least one harness cord in order to displace a heddle not influenced by a warp yarn between two positions of its normal stroke; in memorizing, for this actuator, values representative of this no load effort; in comparing, when an anomaly signal has been generated, the value representative of the afore-mentioned operational effort with the memorized values representative of the no load effort, and in generating a second, so-called "warp yarn rupture signal" when the representative values compared are substantially identical. The method of the invention therefore makes it possible not only to detect an anomaly in the formation of the shed but to detect the cause thereof, namely the rupture of a warp yarn, when it can be established that the effort exerted by the actuator is substantially equal to the effort that it exerts in the absence of a warp yarn.

It further consists in determining a so-called "unloaded effort" exerted by the actuator on at least one harness cord in order to displace, between two positions of its stroke, a heddle connected to a warp yarn which is normally taut but disconnected from the elastic return means; in memorizing, for this actuator, values representative of this unloaded effort; in comparing, when the anomaly signal has been generated, the value representative of the operational effort with the memorized values representative of the unloaded effort, and in generating a third, so-called "elastic return means rupture signal" when the representative values in question are substantially identical. According to this aspect of the invention, the method makes it possible to identify the rupture or unhooking of a return spring of a heddle associated with a warp yarn, which guides the operator in the repair to be carried out.

It consists in generating a fourth, so-called "connection rupture signal" when the value representative of the operational effort is substantially zero. In effect, when the effort generated by the actuator is zero, this means that it is no longer kinematically connected to the heddle which is in that case no longer driven.

It consists in activating the actuator for which an anomaly signal has been generated so as to render distinctive the or each heddle driven by this actuator. This aspect of the invention takes advantage of the fact that it is certain that the actuator for which an anomaly has been detected is located by the controller of the Jacquard mechanism, this then allowing the operator to locate the anomaly more readily. It may be provided to displace the or each heddle driven by the actuator in question towards a position visibly offset with respect to that of the other heddles, for example a top position of its stroke, while the other heddles are displaced towards a bottom position of their stroke. It may also be provided to impart an oscillating movement to the or each heddle driven by the actuator in question, while the other heddles are immobilized. In any case, the operator immediately locates the warp yarn or yarns on which his verifications are to be concentrated.

It consists in determining the afore-mentioned efforts by measuring at least one electrical supply parameter of the actuator.

It consists in repeatedly determining, memorizing and comparing the afore-mentioned efforts for each actuator of the loom during operation thereof. This systematic nature guarantees the efficiency of the surveillance envisaged.

It consists in determining the value of the effort exerted by a warp yarn on a heddle and in generating an anomaly signal when the value of this effort is substantially different from a reference value.

The method of the invention therefore allows the rapid detection of an anomaly of the shed, its treatment, particularly by stopping the loom, and the localization of this anomaly, particularly by locating the actuator concerned. According to variant embodiments of the method, it even allows the type of anomaly encountered to be identified.

The invention also relates to a device for carrying out the method described hereinbefore, and, more specifically, to a device comprising:

means for determining at least one reference effort exerted by at least one actuator on at least one harness cord in order to displace at least one heddle between two positions of its stroke, under predetermined conditions;

a memory adapted to store values characteristic of this reference effort;

means for determining a so-called "operational effort" exerted by the actuator on the harness cord when the loom is in operation;

means for comparing values characteristic of the operational effort and threshold values established from the memorized values characteristic of the reference effort, and a logic unit adapted to identify an abnormal value of the operational effort thanks to the results furnished by the comparison means.

The reference effort may be the normal effort identified hereinabove, but may equally well be the "no load" and "unloaded" efforts for which the means of determination used are identical.

According to an advantageous aspect of the invention, the device comprises means for displaying the reference and/or the position of the or each heddle driven by an actuator for which the logic unit has detected an abnormal value. These means may include an indicator which the operator consults in order to know on which part of the loom he must intervene.

Finally, the invention relates to a Jacquard type weaving loom equipped with a device as described hereinbefore. Such a loom is more economical than the looms equipped with conventional warp stop motion devices, while it is easier to use for an operator and it does not require tedious threading operations. In addition, such a loom may allow automatized repairs when an anomaly is observed, as the device and the method of the invention allow a precise identification of the cause of an anomaly and its physical location on the loom.

BRIEF DESCRIPTION OF THE DRAWINGS

The invention will be more readily understood on reading the following description of an embodiment of a weaving loom in accordance with its principle and of a method of detecting anomalies carried out on this loom, given solely by way of example and made with reference to the accompanying drawings, in which.

DESCRIPTION OF PREFERRED EMBODIMENT

Figure 1:
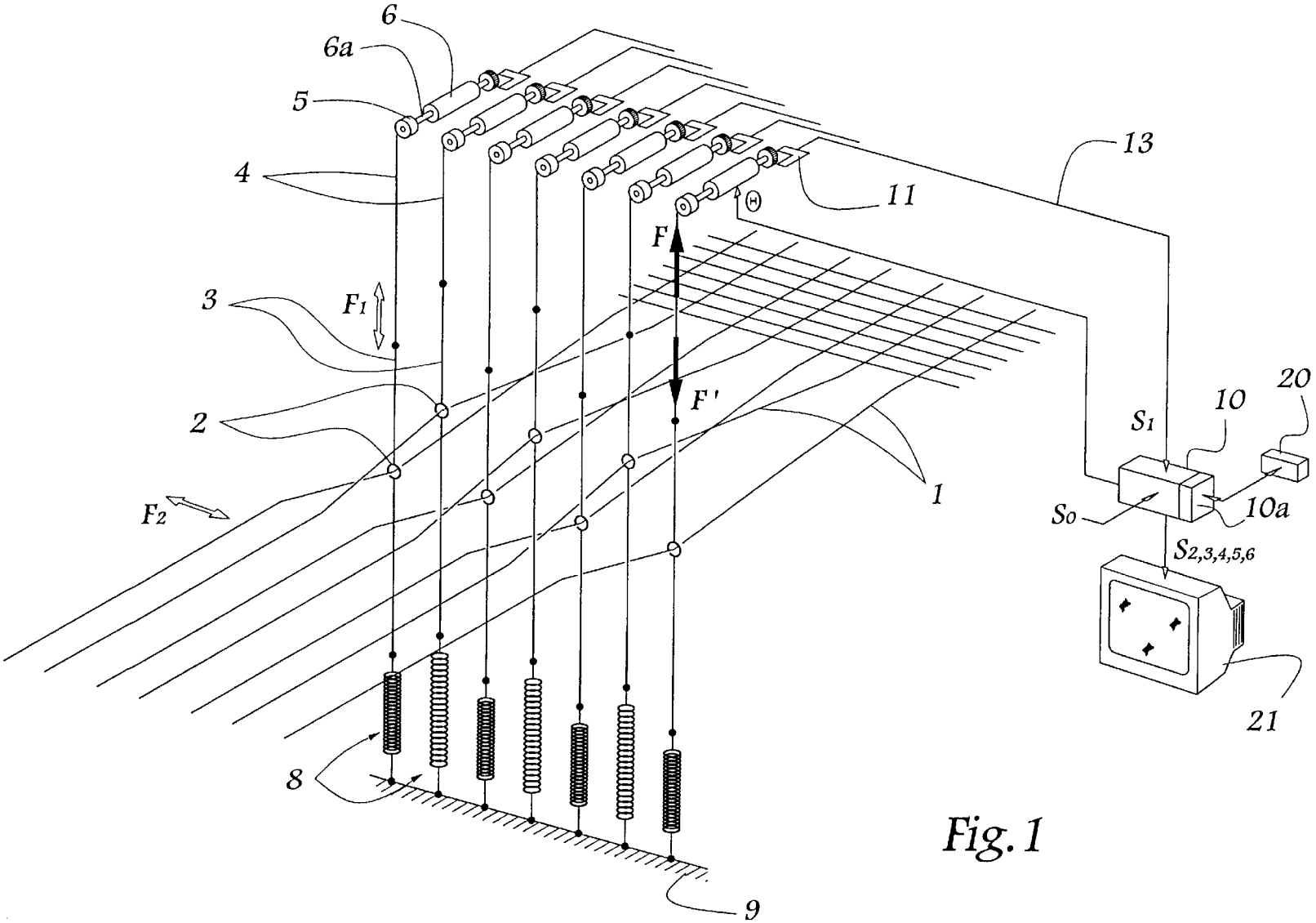
FIG. 1 schematically shows the principle of a weaving loom according to the invention.

Referring now to the drawings, the efforts represented in FIGS. 2 to 5 are static efforts. In practice, real dynamic efforts incorporate oscillatory components due to the vibrations, as well as forces of inertia and of friction, these components and these forces not being shown in order to render the drawings clearer.

The weaving loom shown schematically in FIG. 1 comprises warp yarns 1 each traversing an eyelet 2 of a heddle 3 animated by a vertical movement of oscillation, represented by arrow $F_1$ substantially perpendicular to the direction of the movements of the weft yarns represented by arrow $F_2$. Each heddle 3 is connected by a harness cord 4 to a pulley 5 driven in rotation by an electric servomotor 6. In its lower part, each heddle 3 is connected to a spring 8 secured to the frame 9 of the loom.

As represented for the motor 6 furthest to the right in FIG. 1, each motor is controlled in position by a monitoring unit 10 which receives a position setting signal $S_0$.

A detector 11 installed to the rear of each motor 6 makes it possible to effect a servo-control in position for a precise monitoring of the motor 6 thanks to a signal $S_1$ which it addresses to unit 10 via an electrical link 13. The unit 10 compares the signals $S_0$ and $S_1$ and calculates the current necessary for compensating the difference between these signals. This current is used for controlling the motor 6 in accordance with the principle of closed-loop servo-control in position.

The motors 6 are of brushless type, with the result that the couple exerted by each motor 6 is proportional to the current that it consumes at each instant. Now, the unit 10 furnishes to each motor 6 the current necessary for its displacement, with the result that it is possible to know by the unit 10 the value of this current, i.e. the value of the effort exerted by each motor 6. This couple, known by unit 10, is proportional to the effort F that the pulley 5 exerts on the harness cord 4, this effort F being substantially equal to the effort of reaction F' exerted by the harness cord 4 in question on the pulley 5.

Figure 2:
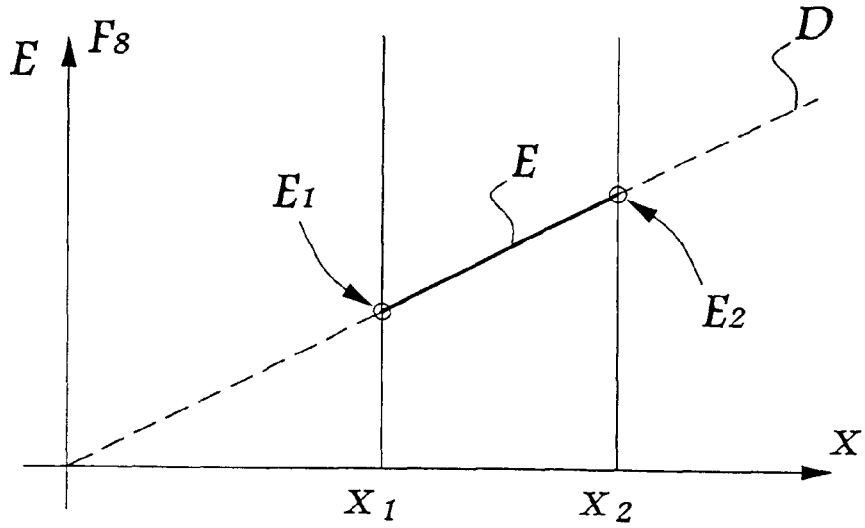
FIG. 2 schematically shows the principle of the effort exerted by an actuator of the loom of FIG. 1 when no warp yarn is engaged in the heddle driven by the actuator.

Considering that each spring 8 has an essentially linear characteristic in its normal operational zone, the latter may be represented by the straight line D in FIG. 2 in a representation of the effort $F_8$ exerted by a spring 8 as a function of the position x of an eyelet 2 between two extreme positions $x_1$ and $x_2$ corresponding to the limits of its normal stroke. The effort $E_1$ exerted by the motor 6 in order to overcome the elastic return effort of each spring 8 between the positions $x_1$ and $x_2$ is represented by a portion of the straight line D defined between the extreme positions $x_1$ and $x_2$. The effort $E_1$ is substantially linear between two extreme values $E_1$ and $E_2$. The value of the effort E corresponds to the value that a motor 6 must exert in order to displace a no-load heddle 3, i.e. a heddle in which no warp yarn is engaged.

Figure 3:
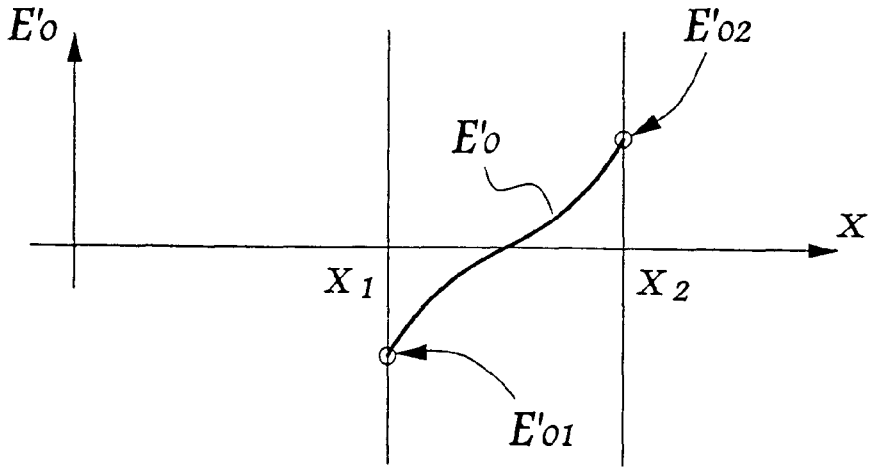
FIG. 3 shows the principle of the normal effort exerted by a warp yarn on the heddle with which it is associated.

Further, and as emerges more particularly from FIG. 3, if a heddle 3 is considered, in whose eyelet a taut warp yarn passes without this heddle being connected to a spring 8, the effort $E'_0$ which must be exerted on the heddle in order to displace it between the two extreme positions $x_1$ and $x_2$ located respectively below and above the warp yarn, presents a substantially "S" shape between two extreme values $E'_{01}$ and $E'_{02}$ of opposite signs. This corresponds to the fact that the warp yarn 1 is taut and it should be drawn upwardly or downwardly in order to displace it with respect to its median position.

Figure 4:
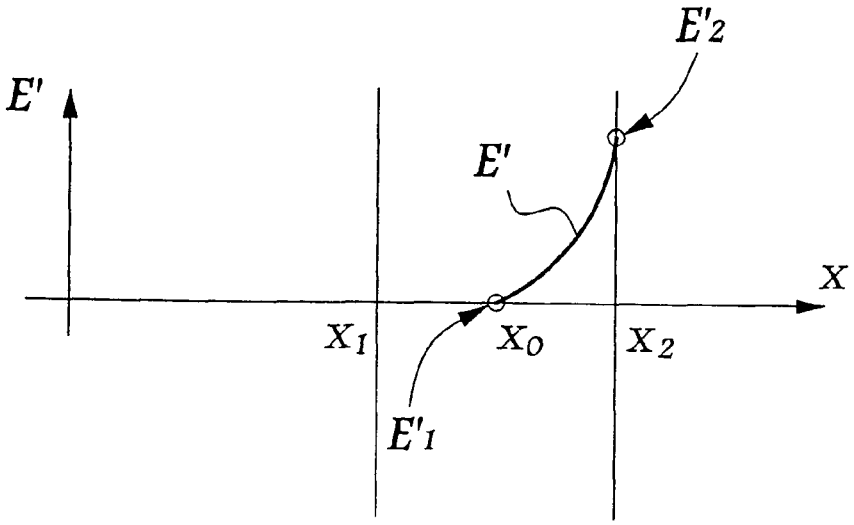
FIG. 4 is a view similar to FIG. 2 when a heddle is not connected to the frame of the loom by a return spring.
Figure 5:
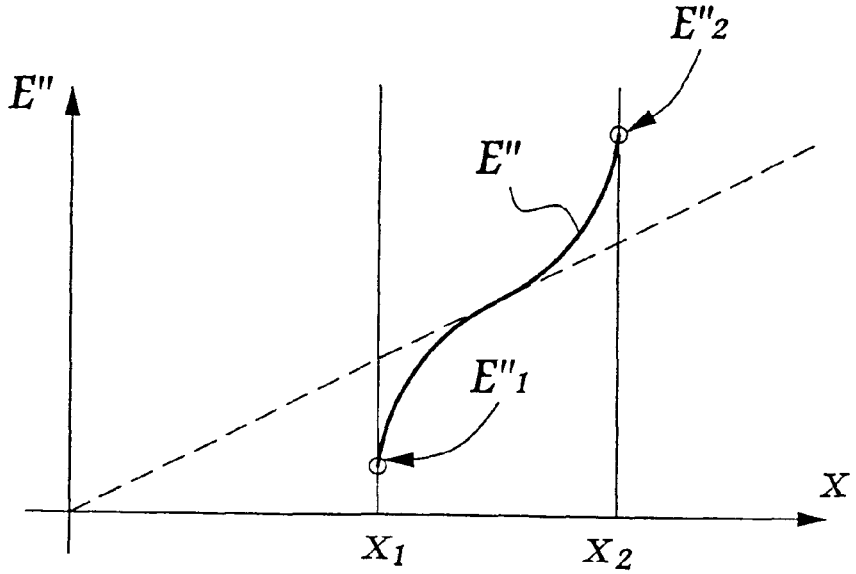
FIG. 5 is a view similar to FIG. 2 when the weaving loom is operating normally.

In practice, taking into account the supple nature of the harness cord 4, the motor 6 cannot push the heddle 3 towards the position $x_1$, with the result that the effort E' exerted by the motor on a heddle, in which a warp yarn passes but which is not connected to the frame 9 by a spring 8, has the distribution represented in FIG. 4 where $E'_1$, and $E'_2$ denote its extreme values, the position $x_1$ not being attained, with the result that the value $E'_1$ corresponds to a median position $x_0$.

When a warp yarn 1 passes through the mail 2 of a heddle 3 connected to a spring 8, the effort E" that the corresponding motor 6 must exert is the superposition of the efforts E and $E'_0$ as the harness cord 4 is permanently subjected to traction. This effort E" has the form represented in FIG. 5. It varies between two extreme values $E''_1$ and $E''_2$ which are in fact the sum of the values $E_1$ and $E'_{01}$, on the one hand, and $E_2$ and $E'_{02}$, on the other hand, without taking into account the inertia, friction and/or vibratory efforts.

The method of the invention is carried out as follows:

During a first step 101, each motor 6 is actuated in order to displace the heddle 3 which drives between the extreme positions of its normal stroke, this being effected by eliminating the tension on the warp yarns or by proceeding before the warp yarns 1 are introduced in the eyelets 2. While each motor 6 is operating, the value of the effort E exerted by this motor is determined. In particular, values $E_1$ and $E_2$ are determined, which are then memorized during a subsequent step 102, the values of $E_1$ and $E_2$ being transmitted to a memory 20 associated with the unit 10. The warp yarns 1 introduced in the eyelets 2 are then given a tension representative of that which they present during weaving.

The eyelets are displaced between their extreme positions $x_1$ and $x_2$, while the warp yarn is normally stretched so as to determine, in a step 103, the normal effort during weaving E" and the corresponding extreme values $E''_1$ and $E''_2$. During a subsequent step 104, the values of $E''_1$ and $E''_2$ are memorized in the memory 20.

From the values $E''_1$ and $E''_2$, a range of values of normal effort is determined, for example around these values, to within plus or minus 5%, this range in that case being limited by values of $E''_1-5\%$ and $E''_1+5\%$ or $E''_2-5\%$ and $E''_2+5\%$. In this respect, the values $E''_1$ and $E''_2$ are threshold values representative of the limits of the normal operational range.

From these values stored in the memory 20, the values of $E'_{01}$ and of $E'_{02}$, and, more generally, the distribution and intensity of the effort $E'_0$, may be determined by subtraction, in a step 105. As a function of the supposed tension of the warp yarn in question, the value of $E'_0$ thus determined may be compared to a reference value $E_{0ref}$ and the operator may be warned in the event of a significant difference, which corresponds to too great or too weak a tension of the warp yarn. In that case, an anomaly signal $\Sigma_0$ is generated and displayed on a screen 21, identifying the actuator and/or the heddle in question, which facilitates the location of the warp yarn to be monitored.

From the values of $E'_0$, and more specifically of $E'_{01}$ and of $E'_{02}$, the values of E', $E'_1$ and $E'_2$ may be calculated during a step 105', and memorized in the memory 20, during a step 106'.

All the afore-mentioned operations are carried out before the weaving operations effectively begin. During weaving and, preferably, upon each movement of a pick, there is determined, in a step 107, the effort K effectively exerted by each motor 6 which displaces a heddle towards its top dead center or towards its bottom dead center. The extreme value $K_1$ or $K_2$ of the effort K corresponding to the extreme position $x_1$ or to the extreme position $x_2$ is determined thanks to the electrical supply parameters of each motor 6. Depending on the direction of displacement provided for the heddle 3, the value $K_1$ or $K_2$ is then compared with the value memorized for the normal effort, i.e. with the value $E''_2$ in the case of the corresponding heddle 3 being displaced so that its eyelet 2 attains the position $x_1$, or with the value $E''_2$ in the case of the eyelet 2 being displaced towards position $x_2$. When the loom is operating normally, the extreme value $K_1$ or $K_2$ must be substantially equal to $E''_1$ or to $E''_2$. A comparison of these values for each motor 6 is effected in a comparator 10*a* of the unit 10, during a step 108.

If the result of the comparison is positive, i.e. if the difference between the value of the operational effort $K_1$ or $K_2$ and the memorized value $E''_1$ or $E''_2$ is small, for example less than 5% of $E''_1$ or $E''_2$, it is considered that the effort K is in the range of values of normal effort, defined by $E''_1\pm5\%$, $E''_2\pm5\%$, and that the loom is operating correctly and a step 107 is re-initialized for the next passage of a pick.

In the contrary case, an anomaly signal $S_2$ is generated and the loom is stopped by the unit 10 which displays a corresponding message on the screen 21. This message identifies the motor 6 for which abnormal operation has been detected and, consequently, allows an operator to know on which part of the loom his verifications must be concentrated. In fact, the message displayed on the screen 21 indicates which warp yarn 1 is the cause, since the unit 10 has memorized the references of each warp yarn associated with each motor.

In addition, in order to facilitate location of the warp yarn in question, the servo-motor 6 for which an abnormal situation has been detected, is provided to be controlled by the unit 10, during a step 109, so as to bring the heddle 3 into position offset upwardly or downwardly with respect to the adjacent heddles. For example, heddle 3 may be displaced towards its position of top center point while the other actuators are controlled to bring all the other heddles into position of bottom dead center, which makes it possible to form with the warp yarns a lower band or layer from which the warp yarn, at whose level a problem has been detected, normally emerges.

According to a variant embodiment, it may be provided to immobilize all the warp yarns, except for the one for which an abnormal situation has been detected, this motor 6 in that case being controlled in order to generate vertical oscillation movements of low amplitude of the heddle 3 which it drives, such a movement being easily localized by an operator.

Advantageously but not necessarily, it may also be provided to continue the comparison of the value K, noted for a motor corresponding to abnormal operation, with the value $E_1$ and $E_2$. If this comparison, made during step 110, shows that the value $K_1$ or $K_2$ of K is substantially equal to one of the values $E_1$ or $E_2$ depending on the direction of displacement, it may be deduced that the harness cord 4, the heddle 3, the rod 7 and the spring 8 are in a configuration similar to that encountered during step 101, i.e. the warp yarn exerts a zero or negligible effort on the eyelet 2, which leads to the conclusion that the warp yarn is broken. In that case, a corresponding so-called "warp yarn rupture" signal $S_3$ is generated by the unit 10 and a corresponding message is displayed on the screen 21.

In the contrary case, the value $K_1$ or $K_2$ of K is compared in a subsequent step 111 with the previously memorized values of $E'_1$ and $E'_2$. If $K_1$ or $K_2$ is substantially equal to $E'_1$ or $E'_2$, it may be deduced that the heddle 3 does not undergo any effort from the spring 8 associated therewith, this spring being, a prior, able to be considered as defective or disconnected from the corresponding heddle 3 or frame 9.

In that case, a so-called "return means rupture" signal $S_4$ is generated and the unit 10 displays a corresponding message on the screen 21.

In the contrary case, an additional verification is effected during step 112 where the value $K_2$ or $K_2$ of the effort determined during step 107 is compared with 0. If this value is substantially equal to 0, it may be deduced that the motor 6 in question exerts no effort on the harness cord 4 with which it is normally associated, which leads to the conclusion that the link between the motor 6 and the heddle 3 is interrupted, for example at the level of pulley 5. A so-called "rupture of link" signal $S_5$ is then generated by the unit 10 which displays the corresponding message on the screen 21.

In the contrary case, the cause of the anomaly is not detected automatically and the unit 10 generates a message $S_6$ displayed on the screen 21 by which the operator is informed of this state of affairs.

A corrector coefficient may be applied during the step 108 of comparison of the values $K_1$ and $K_2$ representative of the operational effort K with respect to the values $E''_1$ and $E''_2$ representative of the normal effort, insofar as the differences between these values can depend on the type of weave and/or the type of yarn used. For example, the threshold value for which the values of $K_1$ or $K_2$ and of $E''_1$ or $E''_2$ are considered as different may be set at 20% in the case of weaving a cotton cloth and at 5% in the case of weaving an article of silk. In that respect, the signal $S_2$ is generated only if the compared values differ significantly. In other words, the threshold values used depend on the type of weave and/or yarn used.

A similar approach may be adapted for steps 110, 111 and 112 where the comparison is also effected with a corrector coefficient for only significant differences between the compared values to be noted.

In addition, it is advantageous to filter the values of current consumption determined by the unit 10 in order to smooth the instantaneous variations which can be generated, particularly by the catching of two adjacent yarns or by vibrations, such variations of very short duration not being taken into account in the determination of the operational effort K.

The fact that the method is carried out for each of the motors 6 allows a systematic verification of the formation of the shed on the loom. By repeating the steps 107 and 108 while the loom is operating, the verification can be maintained in the course of time.

The method of the invention makes it possible to dispense with a drop wire warp stop motion device and conducting bars and with the operation of threading, while a rapid and precise identification of the warp yarn for which an anomaly has been detected, is possible.

Steps 101, 102, 105 to 106' and 109 to 112 of the method are optional and may be carried out independently from one another, except that steps 110 and 111 respectively necessitate the implementation of steps 101 and 102 or 105 to 106'.

The invention has been presented with electrical actuators constituted by rotary motors of brushless type. However, it is applicable to any other type of electrical actuators of which the effort that they generate may be determined and, in particular to linear motors, for which the determined efforts are not couples but efforts of traction, and to asynchronous motors. The effort is determined by measuring the electrical parameters, real or set, of each actuator.

The invention has been shown with motors 6 connected to a single harness cord itself connected to a single heddle. It is obvious that it would also be applicable with motors controlling a plurality of heddles by means of a plurality of harness cords grouped at the lower end of a common cord.

In a variant embodiment, the method of the invention may include a step of dynamic learning enabling the real configuration of the loom to be taken into account, particularly concerning the length of the harness cords, the geometry of the shed or the mechanical characteristics of the yarns and springs. This makes it possible to obtain values of dynamic efforts forming the subject of a suitable arithmetic processing, posterior to this dynamic learning.

Taking into account the precision of the signals $S_2$ to $S_5$ generated by the unit 10 as a function of the comparisons made, the invention makes it possible to envisage an automatized repair of the shed by means of an automat such as a multiple-axis robot.

The invention has been described while only the extreme values $E_1$, $E_2$, $E'_1$, $E'_2$, $E''_1$ and $E''_2$ are memorized and/or compared. Of course, as a function of the size of the memory 20 and of the computing power available, it may be provided to use more values representative of each effort. In particular, instantaneous values of the efforts may be used at noteworthy points, average values or any other value resulting from an arithmetic processing of an assembly of values collected on a turn of the loom or on a plurality of turns. The representative threshold values are then calculated as a function of the determined values. In a variant embodiment, it may be provided to note real normal values of the weaving effort in different configurations of use and to create an "envelope" curve of these values, the afore-mentioned threshold values in that case corresponding, at each point, to the values of these envelope curves to or from which a corrector coefficient is added or subtracted.

Figure 6:
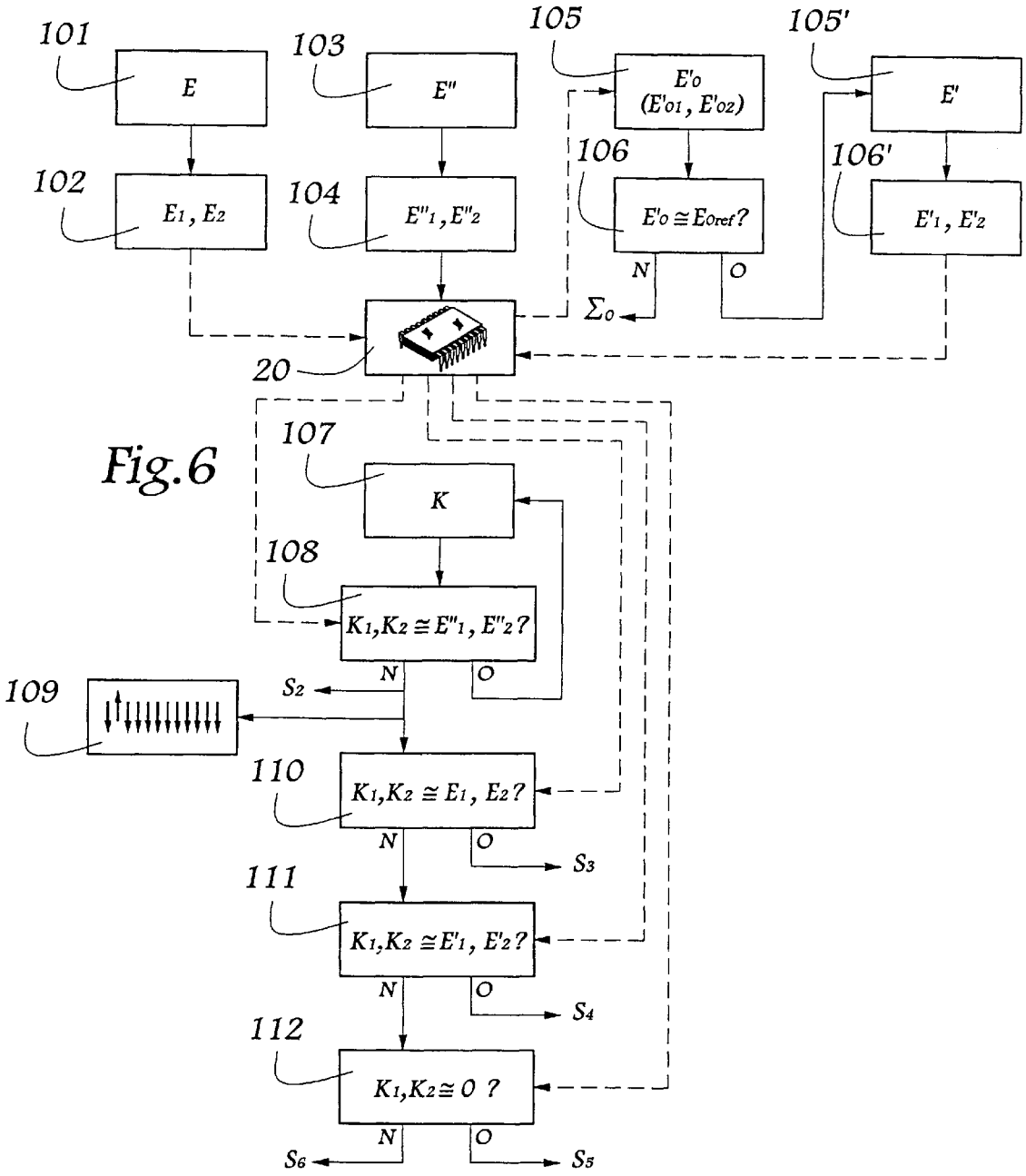
FIG. 6 is a block diagram of the method of the invention.

The invention has been described with return springs 8. However, it is applicable with other types of return means such as the pneumatic device disclosed in EP-A-0 860 528 or in the absence of such means, as in the known device of the embodiment of FIGS. 6 and 8 of FR-A-2 772 796.

What is claimed is:

1. Method for detecting an anomaly in the formation of a shed in a Jacquard-type weaving loom which includes electrical actuators for controlling movement of harness cords for displacing heddles controlling position of warp yarns of the loom, including the steps of:

determining a normal weaving effort, exerted by at least one actuator on at least one harness cord in order to displace, between two positions ($x_1$, $x_2$) of normal stroke of at least one heddle connected to a normally taut warp yarn;

determining, from this normal effort, at least one threshold value ($E''_1$, $E''_2$) representative of a limit of a range of values of normal weaving effort;

determining, while the loom is in operation, an operational effort (K) exerted by said at least one actuator on said at least one harness cord;

comparing at least one value ($K_1$, $K_2$) representative of said operational effort (K) with the threshold value ($E''_1$, $E''_2$); and generating a first anomaly signal ($S_2$) when the value representative of the operational effort is outside said range of values.

2. Method according to claim 1, including the additional steps of:

determining a no load effort (E), exerted by said at least one actuator on said at least one harness cord in order to displace said at least one heddle when said at least one heddle is not influenced by the warp yarn between said two positions ($x_1$, $X_2$) of the normal stroke;

memorizing for said at least one actuator, values ($E_1$, $E_2$) representative of said no load effort;

comparing, when the anomaly signal ($S_2$) has been generated, said at least one value ($K_1$, $K_2$) representative of said operational effort with the memorized values ($E_1$, $E_2$) representative of said no load effort (E); and generating a second, warp yarn rupture signal ($S_3$) when the representative values ($K_1$, $K_2$, $E_1$, $E_2$) compared are substantially identical.

3. Method according to claim 1, including the additional steps of:

determining an unloaded effort exerted by said at least one actuator on said at least one harness cord in order to displace, between the two positions ($x_1$, $x_2$), of the at least one heddle connected to the warp yarn which is normally taut and not connected to an elastic return means;

memorizing, for said at least one actuator, values ($E'_1$, $E'_2$) representative of said unloaded effort;

comparing, when said anomaly signal has been generated, said at least one value ($K_1$ $K_2$) representative of said operational effort (K) with the memorized values ($E'_1$, $E'_2$) representative of said no load effort (E); and generating a third elastic return means rupture signal ($S_4$) when the representative values ($K_1$, $K_2$, $E'_1$, $E'_2$) compared are substantially identical.

4. Method according to claim 1, including an additional step of generating a fourth connection rupture signal ($S_5$) when the at least one value ($K_1$, $K_2$) representative of said operational effort (K) is substantially zero.

5. Method according to claim 1, including an additional step of activating the at least one actuator for which an anomaly signal ($S_2$) has been generated so as to render distinctive the at least one heddle moved by said actuator.

6. Method according to claim 5, including displacing the at least one heddle moved by said at least one actuator towards a position visibly offset with respect to that of other heddles of the loom.

7. Method according to claim 5, including imparting an oscillating movement to the at least one heddle moved by said at least one actuator, while maintaining other heddles of the loom immobilized.

8. Method according to claim 1, including determining said efforts (E, E', E", K) by measuring at least one electrical supply parameter of said at least one actuator.

9. Method according to claim 1, including repeatedly determining, memorizing and comparing said efforts (E, E', E", K) for each actuator of said loom during operation of said loom.

10. Method according to claim 1, including determining a value of an effort ($E'_0$, $E'_{01}$, $E'_{02}$) exerted by the at least one warp yarn on the at least one heddle and in generating another anomaly signal ($\Sigma_0$) when the value of this effort is substantially different from a reference value ($E_{0ref}$).

11. Device for detecting an anomaly in the formation of a shed on a weaving loom of Jacquard type which includes electrical actuators for the displacement of heddles controlling positions of warp yarns of the loom, the device including:

means for determining at least one reference effort (E, E', E") exerted by at least one actuator on at least one harness cord in order to displace at least one heddle between two positions ($x_1$, $x_2$) of a stroke of movement of the at least one heddle, under predetermined conditions;

a memory adapted to store values ($E_1$, $E_2$, $E'_1$, $E'_2$, $E''_1$, $E''_2$) characteristic of said at least one reference effort;

means for determining an operational effort (K) exerted by said at least one actuator on said at least one harness cord when said loom is in operation;

means for comparing values ($K_1$, $K_2$) characteristic of said operational effort and stored values ($E_1$, $E_2$, $E'_1$, $E'_2$, $E''_1$, $E''_2$) characteristic of said reference effort, and a logic unit adapted to identify an abnormal value ($K_1$, $K_2$) of said operational effort determined by said comparison means.

12. Device according to claim 11, including means for displaying information relative to the at least one heddle and at least one actuator for which said logic unit has identified an abnormal value.

13. Jacquard-type weaving loom including electrical actuators for displacing harness cords for moving heddles controlling positions of warp yarns, means for detecting an anormaly in the formation of a shed on the weaving loom, said means for detecting including:

means for determining at least one reference effort (E, E', E") exerted by at least one actuator on at least one harness cord in order to displace at least one heddle between two positions ($x_1$, $x_2$) of a stroke of movement of the at least one heddle, under predetermined conditions;

a memory adapted to store values ($E_1$, $E_2$, $E'_1$, $E'_2$, $E''_1$, $E''_2$) characteristic of said at least one reference effort;

means for determining an operational effort (K) exerted by said at least one actuator on said at least one harness cord when said loom is in operation;

means for comparing values ($K_1$, $K_2$) characteristic of said operational effort and stored values ($E_1$, $E_2$, $E'_1$, $E'_2$, $E''_1$, $E''_2$) characteristic of said reference effort, and a logic unit adapted to identify an abnormal value ($K_1$, $K_2$) of said operational effort determined by said comparison means.

* * * * *